US009706890B2

(12) United States Patent
Jeong et al.

(10) Patent No.: US 9,706,890 B2
(45) Date of Patent: Jul. 18, 2017

(54) VACUUM CLEANING DEVICE

(71) Applicant: Samsung Electronics Co., Ltd., Suwon-si (KR)

(72) Inventors: Joo Seok Jeong, Suwon-si (KR); Sok Won Paik, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 309 days.

(21) Appl. No.: 14/557,572

(22) Filed: Dec. 2, 2014

(65) Prior Publication Data

US 2015/0150426 A1 Jun. 4, 2015

(30) Foreign Application Priority Data

Dec. 4, 2013 (KR) ..... 10-2013-0149882

(51) Int. Cl.

| | |
|---|---|
| ***A47L 9/26*** | (2006.01) |
| ***B65H 75/34*** | (2006.01) |
| ***A47L 5/36*** | (2006.01) |
| ***A47L 9/00*** | (2006.01) |
| ***A47L 9/22*** | (2006.01) |

(52) U.S. Cl.

CPC ..... *A47L 9/26* (2013.01); *A47L 5/362* (2013.01); *A47L 9/009* (2013.01); *A47L 9/22* (2013.01); *B65H 75/34* (2013.01)

(58) Field of Classification Search

CPC . A47L 5/362; A47L 9/26; A47L 9/009; A47L 9/22; B65H 75/34

USPC ..... 15/DIG. 10

IPC ..... A47L 9/26

See application file for complete search history.

(56) References Cited

U.S. PATENT DOCUMENTS

| | | | | |
|---|---|---|---|---|
| 2,661,074 | A | 12/1953 | Gerber | |
| 2006/0039888 | A1* | 2/2006 | Yamaguti | A47L 7/04 424/76.1 |
| 2006/0196688 | A1 | 9/2006 | Robertson et al. | |

FOREIGN PATENT DOCUMENTS

| | | |
|---|---|---|
| JP | 54-100148 | 8/1979 |
| JP | 09-327422 | 12/1997 |
| JP | 2001-212035 | 8/2001 |
| WO | 2012/075248 | 6/2012 |

OTHER PUBLICATIONS

Extended European Search Report dated Apr. 30, 2015 in European Patent Application No. 14196132.6.

* cited by examiner

*Primary Examiner* — David Redding
(74) *Attorney, Agent, or Firm* — Staas & Halsey LLP

(57) ABSTRACT

A vacuum cleaning apparatus includes a body; a power cord that extends from the body; a cord reel rotatably installed in the body and around which the power cord is wound; and a blower assembly that generates a suction force, wherein the cord reel is formed in a hollow, cylindrical shape, and the blower assembly is disposed inside the cord reel. The size of the cord reel may be formed to be sufficiently large while the size of the body may be maintained in a compact form.

7 Claims, 5 Drawing Sheets

VACUUM CLEANING DEVICE

CROSS-REFERENCE TO RELATED APPLICATIONS

This application claims the priority benefit of Korean Patent Application No. 10-2013-0149882, filed on Dec. 4, 2013 in the Korean Intellectual Property Office, the disclosure of which is incorporated herein by reference.

BACKGROUND

1. Field

The following description relates to a vacuum cleaning device in which a cord reel for winding a power cord is included in a body.

2. Description of the Related Art

In general, a vacuum cleaning device is a home appliance that performs cleaning by generating a suction force, suctioning foreign substances including dust, together with air and then filtering the foreign substances and discharging only the air to the outside of the device.

The vacuum cleaning device includes a body having a fan motor disposed therein, a handle that is connected to the body through a connection hose for a user to grasp, and a head assembly that is connected to the handle through a connection pipe and suctions the foreign substances including dust, together with the air by receiving the suction force.

Also, a power cord extends from the body, is connectable to an external power supply, and allows power to be supplied to the body. When the vacuum cleaning device is not in use, a cord reel for winding the power cord and allowing the power cord to be kept in the body, is included in the body.

SUMMARY

Therefore, it is an aspect of the present disclosure to provide a vacuum cleaning device in which a cord reel may be formed to have a sufficiently large size to accommodate the power cord while a body may be maintained in a compact size.

Additional aspects of the disclosure will be set forth in part in the description which follows and, in part, will be obvious from the description, or may be learned by practice of the disclosure.

In accordance with an aspect of the present disclosure, a vacuum cleaning device includes a body; a power cord that extends from the body toward an outside of the body and is connectable to an external power source; a cord reel which is rotatably installed in the body and around which the power cord is wound; and a blower assembly that generates a suction force, wherein the cord reel may be formed in a hollow, cylindrical form, and the blower assembly may be disposed inside the cord reel.

The cord reel may include a mounting groove that is formed in an outer circumferential surface of the cord reel to have a spiral shape so that the power cord may be seated in the mounting groove.

The vacuum cleaning device may further include a reel cover that covers an outside of the cord reel.

The reel cover may include a guide portion that protrudes toward an inside of the reel cover in a radial direction of the reel cover, and a distance between an inner circumferential surface of the guide portion and the mounting groove may correspond to a diameter of the power cord.

The vacuum cleaning device may further include an elastic member that is disposed at one side of the cord reel and elastically supports the cord reel so that the cord reel may be rotated in one direction.

The vacuum cleaning device may further include a brake roller that is installed to be spaced apart from the cord reel and selectively restricts rotation of the cord reel according to a position of the brake roller.

The blower assembly may include a fan motor that generates a suction force and a blower housing that accommodates the fan motor and guides air discharged from the fan motor.

The vacuum cleaning device may further include a filter disposed in the cord reel and that filters air discharged from the blower assembly before the air discharged from the blower assembly is discharged to an outside of the cord reel.

The vacuum cleaning device may further include a guide roller that guides the power cord to be seated in the mounting groove, wherein the guide roller may be disposed in parallel to the cord reel so that a distance between an outer circumferential surface of the guide roller and an inner surface of the mounting groove may correspond to the diameter of the power cord.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
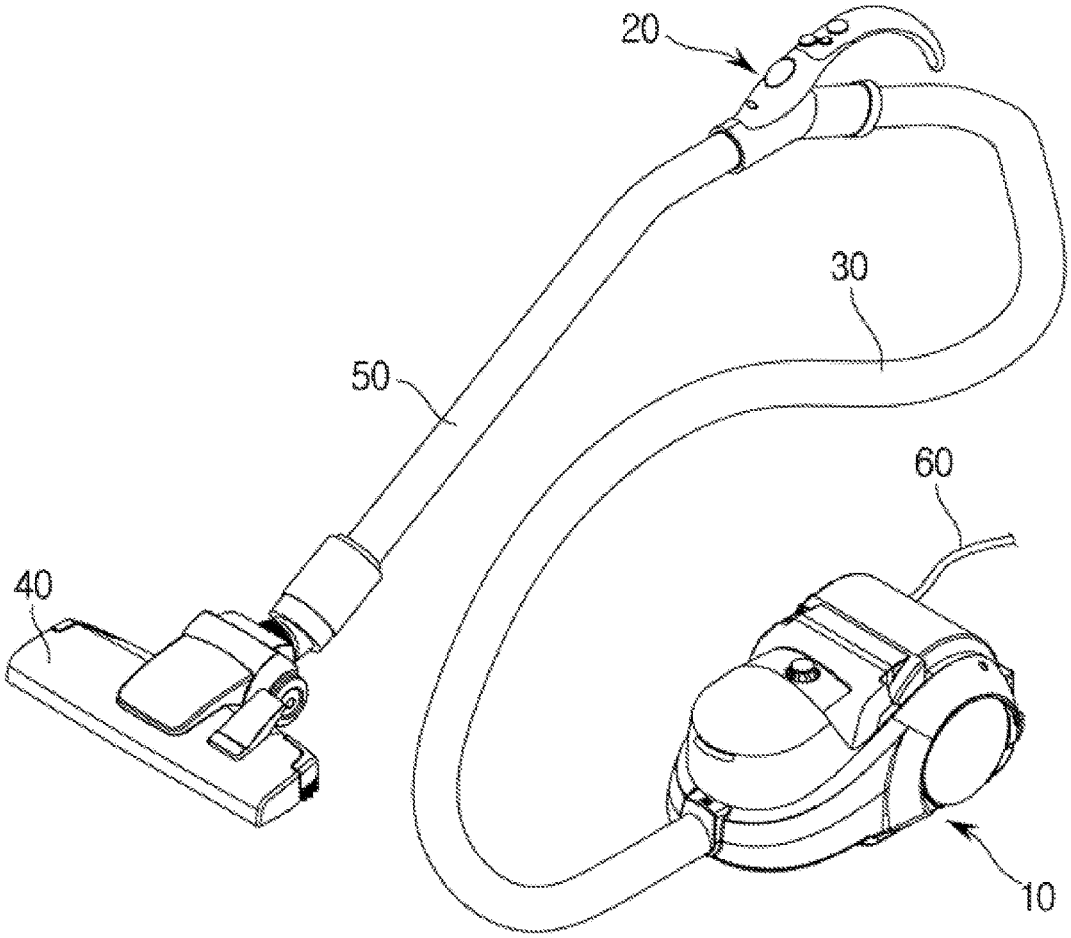
FIG. 1 is a perspective view of a vacuum cleaning device according to an embodiment of the present disclosure.

Reference will now be made in detail to the embodiments of the present disclosure, examples of which are illustrated in the accompanying drawings, wherein like reference numerals refer to like elements throughout.

Hereinafter, a vacuum cleaning device according to an embodiment of the present disclosure will be described with reference to the drawings in detail.

As illustrated in FIG. 1, a vacuum cleaning device according to an embodiment of the present disclosure includes a body 10 including a blower assembly (70, see FIG. 3) that generates a suction force, a handle 20 that is connected to the body 10 through a connection hose 30 for a user to grasp, a head assembly 40 that is connected to the handle 20 through a connection pipe 50 and suctions dust together with air from a bottom surface by receiving the suction force, and a power cord 60 that extends from the body 10, is connected to an external power supply and allows power to be supplied to the body 10.

Figure 2:
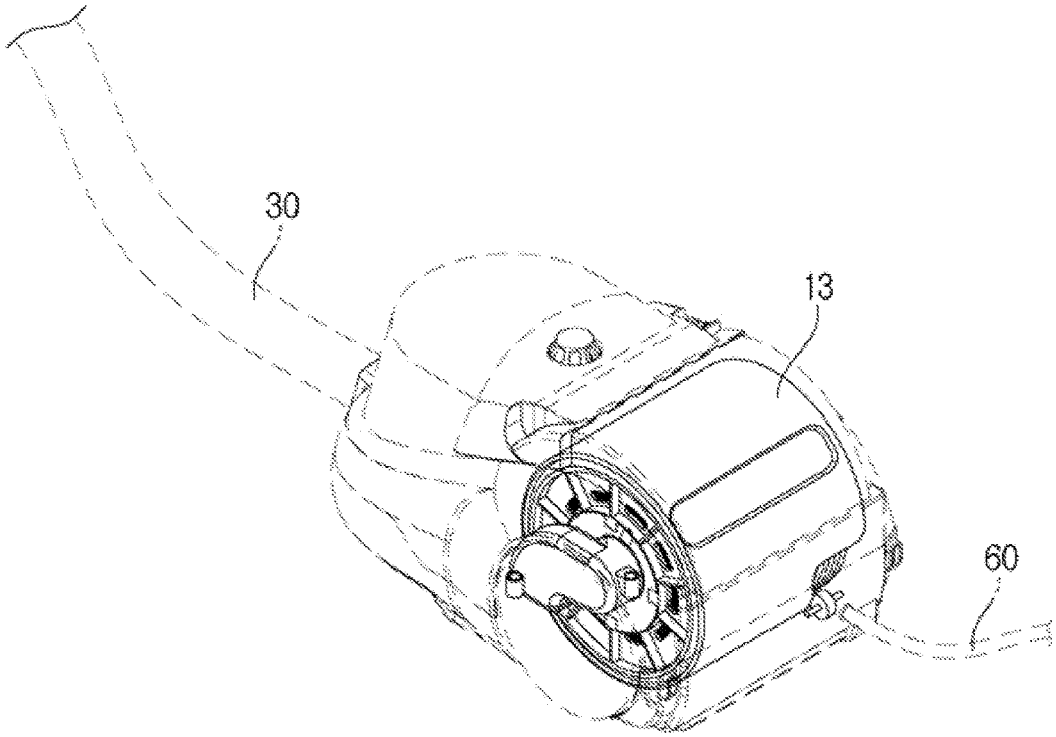
FIG. 2 is a cutaway view of a state in which a cord reel is mounted in the vacuum cleaning device according to an embodiment of the present disclosure.
Figure 3:
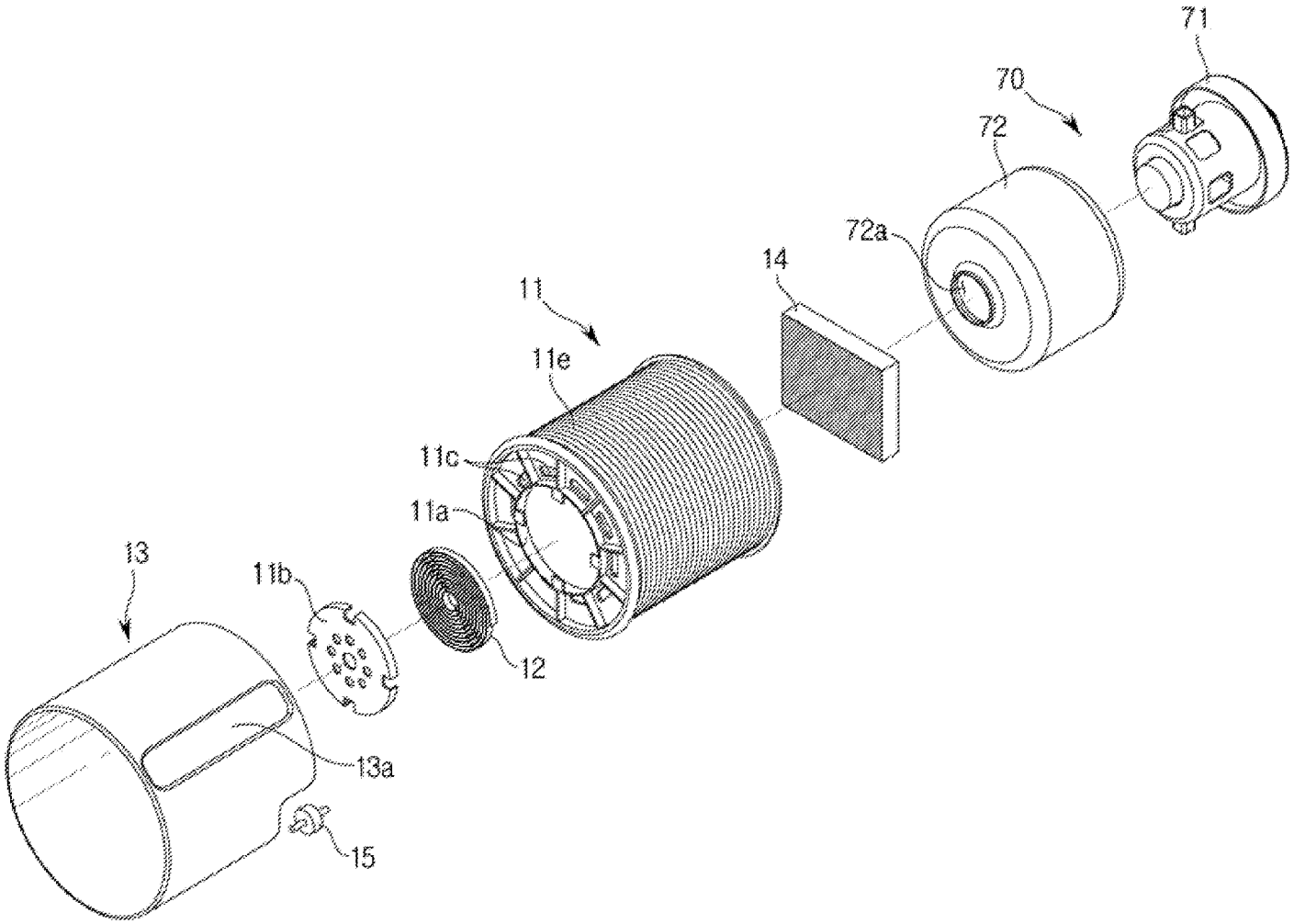
FIG. 3 is an exploded perspective view of the cord reel and a blower assembly of the vacuum cleaning device according to an embodiment of the present disclosure.
Figure 4:
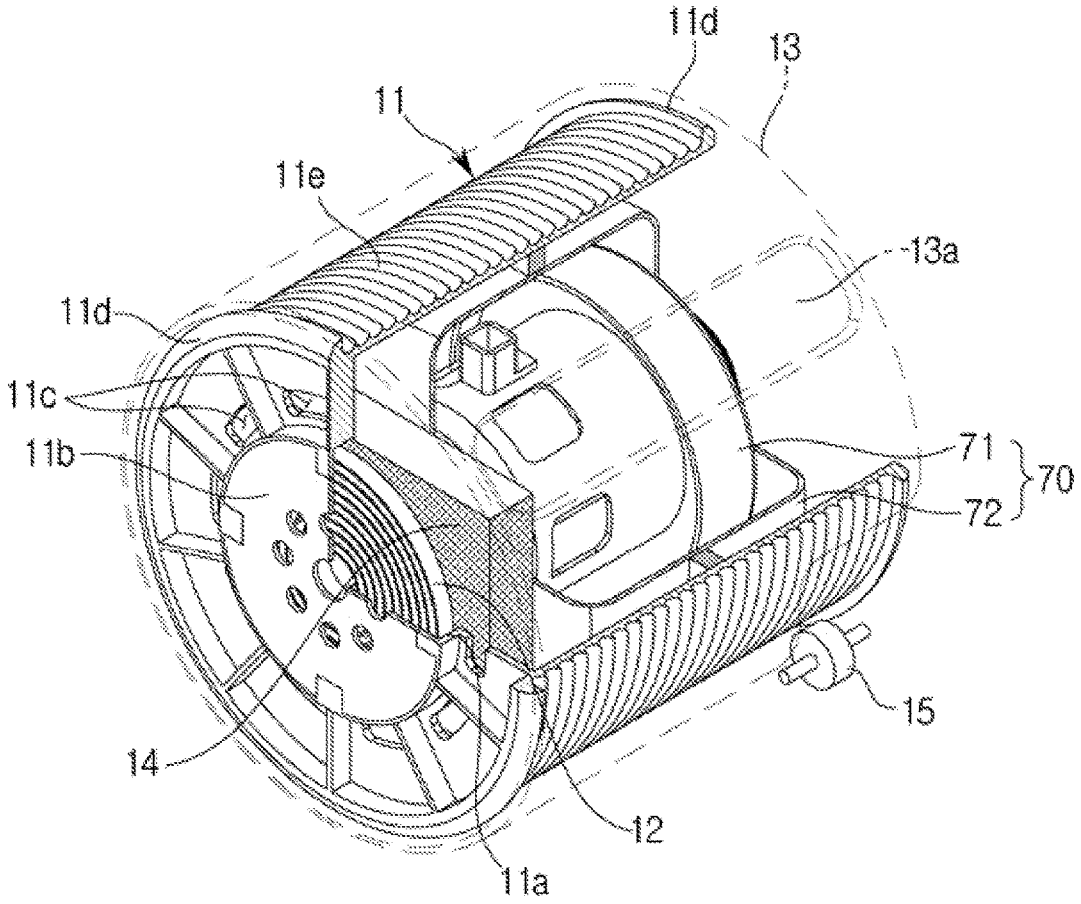
FIG. 4 is a partial cross-sectional perspective view of a state in which the cord reel and the blower assembly are coupled to each other, in the vacuum cleaning device according to an embodiment of the present disclosure.

The blower assembly 70 includes a fan motor 71 that suctions and discharges the air and a blower housing 72 that accommodates the fan motor 71 and guides the air discharged from the fan motor 71, as illustrated in FIGS. 2 through 4.

The fan motor 71 includes a blower fan (not shown) and a motor (not shown) and generates the suction force.

The blower housing 72 is formed in a hollow, cylindrical shape and accommodates the fan motor 71. An outlet 72*a* through which the air flow from the fan motor 71 is discharged, is disposed at one side of the blower housing 72.

Also, the vacuum cleaning device includes a cord reel 11 that winds the power cord 60 and causes the power cord 60 to be kept in the body 10, an elastic member 12 that is disposed at one side of the cord reel 11 and elastically supports the cord reel 11 so that the cord reel 11 may be rotated in one direction, and a reel cover 13 that is installed to cover an outer circumferential surface of the cord reel 11 and guides the power cord 60 so that the power cord 60 may be wound around the cord reel 11.

The cord reel 11 is formed in a hollow, cylindrical shape, and the above-described blower assembly 70 is disposed in the cord reel 11. Thus, the cord reel 11 may be formed to have a sufficiently large size, and the blower assembly 70 may be disposed in the cord reel 11 so that an internal space of the cord reel 11 may be utilized as an installation space for the blower assembly 70. Thus, the size of the vacuum cleaning device may be maintained to be compact.

A circular, elastic member accommodation portion 11*a* is disposed in the center of one surface of the cord reel 11, and an elastic member cover 11*b* that covers the elastic member 12 after the elastic member 12 has been accommodated in the elastic member accommodation portion 11*a*, is installed at the elastic member accommodation portion 11*a*. Also, a plurality of discharge holes 11*c* through which the air discharged from the blower assembly 70 may be discharged to the outside from the cord reel 11, are formed in a periphery of the elastic member accommodation portion 11*a*.

The elastic member 12 may include a leaf spring that is bent into a spiral shape, for example. The elastic member 12 is installed at the elastic member accommodation portion 11*a*, and an external force is applied to the cord reel 11, and when the cord reel 11 is rotated in one direction, the elastic member 12 is elastically deformed. Then, when the external force is released, the elastic member 12 is elastically restored and causes the cord reel 11 to be rotated in an opposite direction.

A guide jaw 11*d* is disposed at both ends of the cord reel 11 and protrudes toward an outside of the cord reel 11 in a radial direction of the cord reel 11. A mounting groove 11*e* is concavely disposed in an outer circumferential surface of the cord reel 11 to have a spiral shape so that the power cord 60 may be seated in the mounting groove 11*e*.

Also, a filter 14 disposed in the cord reel 11 is disposed in a space between the plurality of discharge holes 11*c* and the blower assembly 70, and filters the air discharged from the blower assembly 70 before the air discharged from the blower assembly 70 is discharged toward the outside of the cord reel 11.

The reel cover 13 is formed in a hollow, cylindrical shape so as to accommodate the cord reel 11, and the cord reel 11 is rotatably installed at an inside of the reel cover 13. In this case, an inner circumferential surface of the reel cover 13 and the mounting groove 11*e* of the cord reel 11 are spaced a predetermined distance apart from each other so that the power cord 60 may be wound around the outside of the cord reel 11.

A guide portion 13*a* is disposed in the reel cover 13, protrudes toward the mounting groove 11*e* disposed in the outer circumferential surface of the cord reel 11 and guides the power cord 60 to be stably seated in the mounting groove 11*e*. The guide portion 13*a* protrudes from the reel cover 13 toward an inside of the reel cover 13 in a radial direction of the reel cover 13 and is formed to extend to correspond to the mounting groove 11*e* in parallel to an axis of the reel cover 13. In this case, a distance between an inner surface of the mounting groove 11*e* and the guide portion 13*a* is formed to be slightly larger than a diameter of the power cord 60 so that the power cord 60 may be maintained to be spaced apart from the guide portion 13*a* in a state in which the power cord 60 is seated in the mounting groove 11*e*.

A brake roller 15 is disposed at one side of the cord reel 11 so that rotation of the cord reel 11 may be selectively performed if necessary. The brake roller 15 is maintained to be in contact with the cord reel 11 and is selectively spaced apart from the cord reel 11 by using a button (not shown) disposed at the body 10. Thus, the cord reel 11 is maintained in a stopped state in a state in which the brake roller 15 contacts the cord reel 11, and then, when the brake roller 15 is spaced apart from the cord reel 11, the cord reel 11 is rotated.

An operation of the vacuum cleaning device having the above configuration according to the present disclosure will now be described below.

First, when the user applies a force the power cord 60, the cord reel 11 is rotated, and the power cord 60 is pulled out from the body 10. In this case, as the cord reel 11 is rotated, the elastic member 12 is elastically deformed.

After the power cord 60 is pulled out to a desired length, rotation of the cord reel 11 is suppressed by the brake roller 15 even if the user releases the power cord 60. Thus, the power cord 60 is maintained in a state in which it is pulled out to the desired length.

After the usage of the vacuum cleaning device is finished, when the user presses a button (not shown) disposed at the body 10 so that the brake roller 15 may be spaced apart from the cord reel 11, the elastic member 12 that is elastically deformed is elastically restored and rotates the cord reel 11.

As the cord reel 11 is rotated, the power cord 60 is wound around the cord reel 11. The power cord 60 is guided by the guide portion 13*a* disposed in the reel cover 13 and is seated in the mounting groove 11*e*. Thus, the power cord 60 is wound around the outer circumferential surface of the cord reel 11 to have a spiral shape in which the power cord 60 does not overlap with the mounting groove 11*e* but corresponds to the mounting groove 11*e*.

Figure 5:
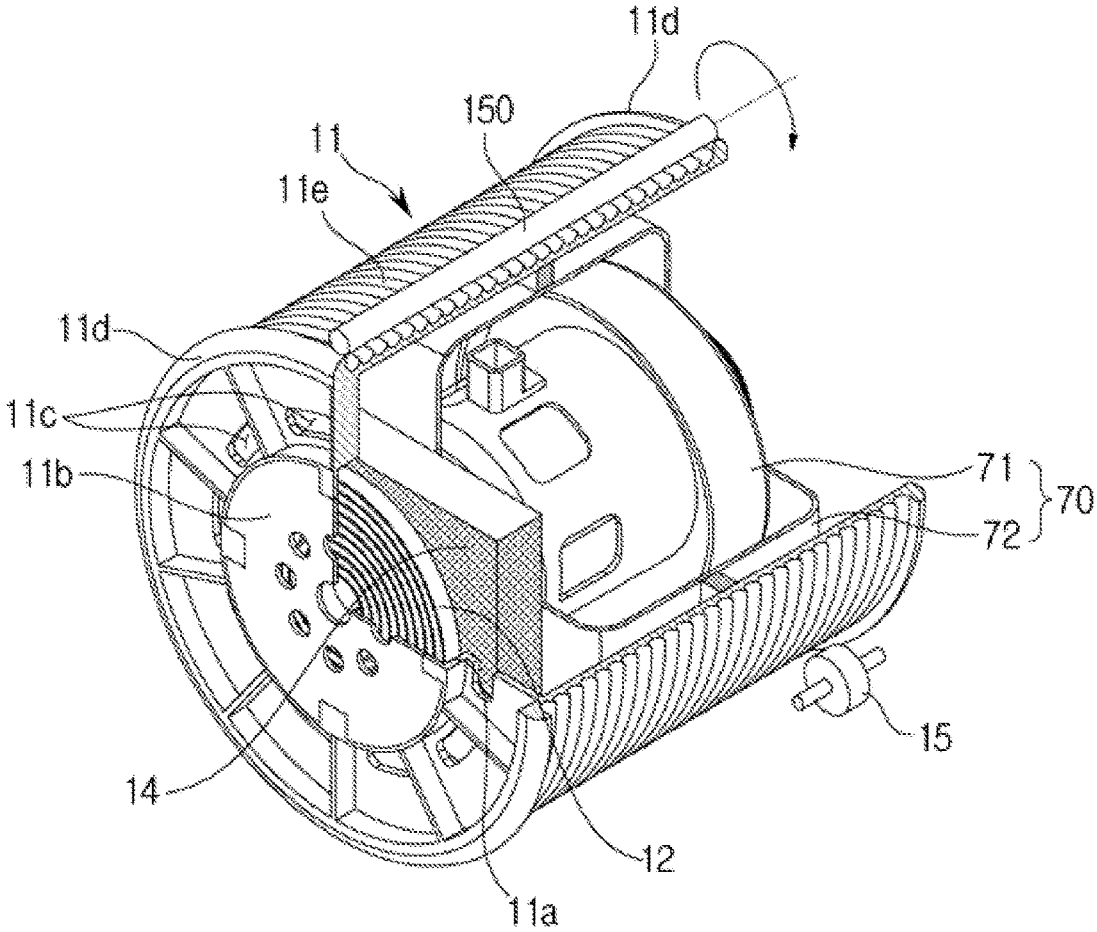
FIG. 5 is a partial cross-sectional perspective view of a state in which the cord reel and the blower assembly are coupled to each other, in a vacuum cleaning device according to an embodiment of the present disclosure.

In the current embodiment, the power cord 60 is guided toward the mounting groove 11*e* by the guide portion 13*a* disposed in the reel cover 13. However, embodiments of the present disclosure are not limited thereto. In another embodiment, the vacuum cleaning device may be configured to include a guide roller 150 disposed in parallel to the cord reel 11 without a configuration that corresponds to the reel cover 13, as illustrated in FIG. 5, and the power cord 60 may be guided toward the mounting groove 11*e* through the guide roller 150.

The guide roller 150 is rotatably installed so that an outer circumferential surface of the guide roller 150 and an inner surface of the mounting groove 11*e* may be spaced apart from each other by a distance that corresponds to the diameter of the power cord 60. Thus, as the cord reel 11 is rotated, the power cord 60 is guided toward the mounting groove 11*e* while being rotated in an opposite direction to that of the cord reel 11.

Although FIG. 1 illustrates a compact vacuum cleaning apparatus as a non-limiting example, the disclosure is not limited thereto. The disclosure may apply to any vacuum cleaning apparatus, such as an upright, canister, drum, wet/dry, pneumatic, backpack, hand-held, robotic, cyclonic, or central vacuum cleaning apparatus, for example.

As described above, the cord reel is formed in a hollow, cylindrical shape so that an inside of the cord reel is used as a space in which the blower assembly is installed. Thus, the cord reel may be formed to be sufficiently large while the size of the body may be maintained in a compact form.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A vacuum cleaning apparatus comprising:

a body;

a power cord that extends from the body;

a cord reel rotatably installed in the body and around which the power cord is wound;

a blower assembly that generates a suction force; and a guide portion to guide the power cord, wherein the cord reel is formed in a hollow, cylindrical shape, and the blower assembly is disposed inside the cord reel, the cord reel comprises a mounting groove that is formed in an outer circumferential surface of the cord reel to have a spiral shape so that the power cord is seated in the mounting groove, and the guide portion guides the power cord to be seated in the mounting groove.

2. The vacuum cleaning apparatus of claim 1, further comprising a reel cover that covers an outside of the cord reel, wherein the guide portion protrudes toward an inside of the reel cover in a radial direction of the reel cover, and a distance between an inner circumferential surface of the guide portion and the mounting groove corresponds to a diameter of the power cord.

3. The vacuum cleaning apparatus of claim 1, further comprising an elastic member that is disposed at one side of the cord reel and elastically supports the cord reel to provide a rotation force to the cord reel in one direction.

4. The vacuum cleaning apparatus of claim 1, further comprising a brake roller that is installed to be spaced apart from the cord reel and selectively restricts rotation of the cord reel according to a position of the brake roller.

5. The vacuum cleaning apparatus of claim 1, wherein the blower assembly comprises a fan motor that generates a suction force and a blower housing that accommodates the fan motor and guides air discharged from the fan motor.

6. The vacuum cleaning apparatus of claim 1, further comprising a filter disposed in the cord reel that filters air discharged from the blower assembly before the air discharged from the blower assembly is discharged to an outside of the cord reel.

7. The vacuum cleaning apparatus of claim 1, further comprising a guide roller that guides the power cord to be seated in the mounting groove, wherein an axis of rotation of the guide roller is disposed in parallel to an axis of rotation of the cord reel so that a distance between an outer circumferential surface of the guide roller and an inner surface of the mounting groove corresponds to the diameter of the power cord.

* * * * *